US008936309B1

(12) United States Patent
Hanlon

(10) Patent No.: US 8,936,309 B1
(45) Date of Patent: Jan. 20, 2015

(54) BOOSTER SEAT AND TABLE

(71) Applicant: Robb S. Hanlon, Wappingers Falls, NY (US)

(72) Inventor: Robb S. Hanlon, Wappingers Falls, NY (US)

( * ) Notice: Subject to any disclaimer, the term of this patent is extended or adjusted under 35 U.S.C. 154(b) by 0 days.

(21) Appl. No.: 13/948,611

(22) Filed: Jul. 23, 2013

(51) Int. Cl.

| | |
|---|---|
| ***A47B 39/00*** | (2006.01) |
| ***A47C 1/11*** | (2006.01) |
| ***A47D 1/10*** | (2006.01) |
| ***A47D 3/00*** | (2006.01) |

(52) U.S. Cl.
CPC . *A47C 1/11* (2013.01); *A47D 1/103* (2013.01); *A47D 3/00* (2013.01)
USPC ..... 297/174 R; 108/50.01; 297/250.1

(58) Field of Classification Search
USPC ..... 297/174 R, 256.16, 250.1; 108/50.01, 108/50.02, 43, 44
See application file for complete search history.

(56) References Cited

U.S. PATENT DOCUMENTS

| | | | | |
|---|---|---|---|---|
| 2,098,655 | A * | 11/1937 | De Lisle | 297/174 R |
| 2,349,092 | A | 5/1944 | Hammer | |
| 2,469,548 | A | 5/1949 | Connelly | |
| 3,016,266 | A * | 1/1962 | Caplan | 297/150 |
| 3,606,451 | A * | 9/1971 | Brownfield et al. | 297/174 R |
| 3,910,659 | A * | 10/1975 | Peterson | 312/226 |
| 4,634,185 | A | 1/1987 | Kassai | |
| 4,854,638 | A * | 8/1989 | Marcus et al. | 297/256.11 |
| 5,474,355 | A * | 12/1995 | Lerner et al. | 297/36 |
| 5,577,800 | A * | 11/1996 | Earl, Jr. | 297/195.11 |
| 6,000,750 | A * | 12/1999 | Rossman et al. | 297/2 |
| 6,033,019 | A | 3/2000 | Hession-Kunz et al. | |
| 6,173,656 | B1 * | 1/2001 | Blanchard | 108/43 |
| 6,773,064 | B2 * | 8/2004 | Treen et al. | 297/255 |
| 6,820,562 | B2 * | 11/2004 | Zodnik et al. | 108/50.01 |
| 6,832,813 | B2 | 12/2004 | Tomas et al. | |
| 6,920,830 | B1 | 7/2005 | Asbach et al. | |
| 7,032,522 | B2 * | 4/2006 | George et al. | 108/50.01 |
| 7,201,445 | B1 * | 4/2007 | Dubiel et al. | 297/256.13 |
| 7,387,337 | B2 * | 6/2008 | Keegan et al. | 297/256.13 |
| 8,091,965 | B2 * | 1/2012 | Flannery et al. | 297/256.16 |
| 8,226,161 | B2 * | 7/2012 | Fiore et al. | 297/153 |
| 8,316,777 | B1 * | 11/2012 | Rosing | 108/49 |
| 8,322,292 | B2 * | 12/2012 | Chen | 108/43 |
| 8,327,774 | B1 * | 12/2012 | Rivera | 108/44 |
| 8,540,312 | B2 * | 9/2013 | Asbach et al. | 297/256.11 |
| 2006/0250005 | A1 | 11/2006 | Keegan et al. | |
| 2009/0015041 | A1 | 1/2009 | Centracco et al. | |
| 2009/0033118 | A1 | 2/2009 | Gomez | |
| 2009/0102257 | A1 * | 4/2009 | Collias | 297/256.16 |
| 2010/0244503 | A1 | 9/2010 | Fiore et al. | |
| 2013/0057031 | A1 | 3/2013 | Kummerfeld et al. | |
| 2013/0248654 | A1 * | 9/2013 | Henshaw et al. | 244/118.6 |
| 2014/0077534 | A1 * | 3/2014 | Stolarz et al. | 297/174 R |

* cited by examiner

*Primary Examiner* — Jose V Chen
(74) *Attorney, Agent, or Firm* — Law Offices of Michael L. Wise, LLC

(57) ABSTRACT

An apparatus for use with a chair is described. The apparatus comprises a booster seat, a table, and mounting hardware. The booster seat is adapted to be positioned on a seat of the chair and to act as a seat for a user. The table, in turn, includes a tabletop, a frontal sidewall, and a device mount. The frontal sidewall is oriented at an oblique angle relative to the tabletop, while the device mount is adapted to attach an electronic display device to the tabletop. Lastly, the mounting hardware is adapted to removably mount the table to the booster seat such that the tabletop is tilted towards the user when the user is seated in the booster seat.

16 Claims, 4 Drawing Sheets

Fig. 4
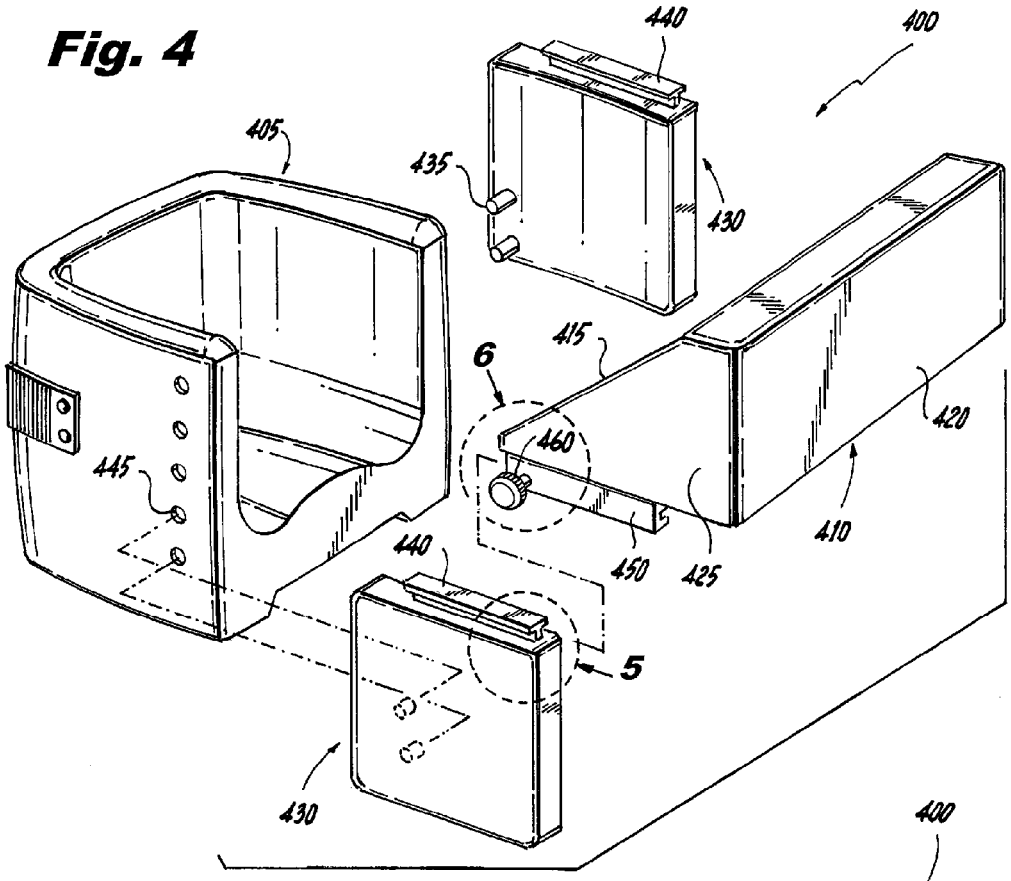
Fig. 5
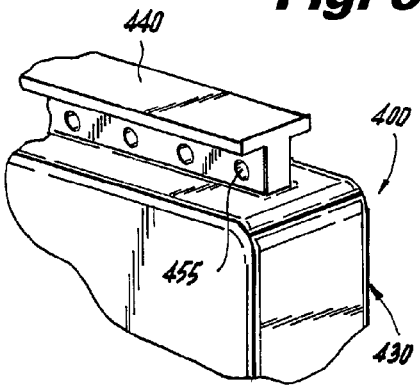
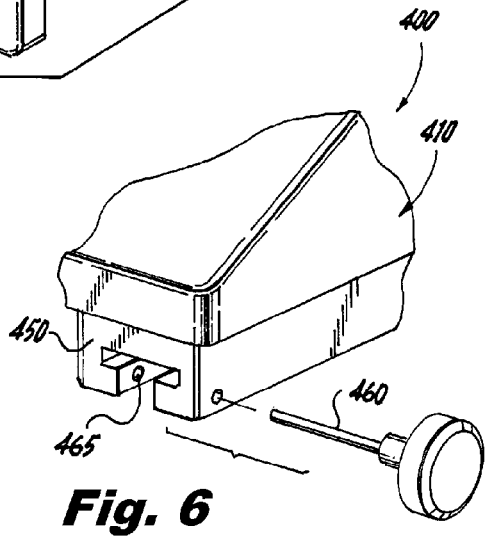
Fig. 6

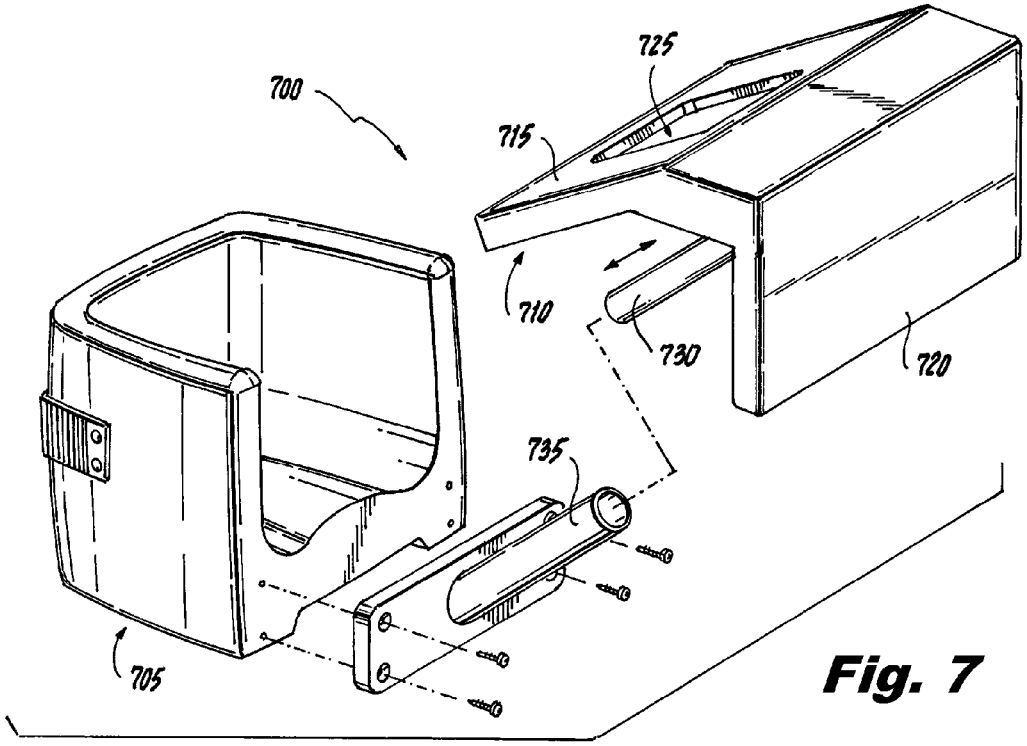
Fig. 7
Fig. 8
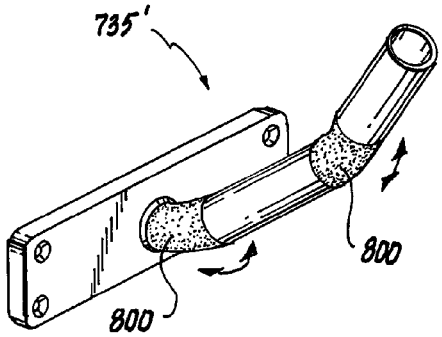

BOOSTER SEAT AND TABLE

FIELD OF THE INVENTION

The present invention relates generally to furniture, and, more particularly, to a table for use with a booster seat.

BACKGROUND OF THE INVENTION

Salon chairs (i.e., barber chairs) are frequently utilized in hair salons, barber shops, and other establishments where hair is cut and styled. Unlike a conventional chair, a salon chair can typically be raised and lowered by a person standing behind the chair so that the height of the chair can be adjusted to accommodate patrons of differing heights. For a child for whom an adult-sized salon chair is too large, a removable booster seat is typically placed on the seat of the salon chair to raise the height of a seated child to a position where that child's hair can be readily accessed. In this setting, the booster seat typically comprises a thick padded cushion shaped to fit onto the seat of the salon chair. The booster seat may also comprise a protective flap that drapes over the front of the salon chair and helps to keep the seated child's feet off of that chair.

Keeping a child occupied and still while cutting that child's hair is a challenge faced by almost all hair stylists. A fidgety child not only makes the cutting of hair difficult, but also raises a concern about safety since a hair stylist will be using sharp cutting implements such as scissors. There is, as a result, the need for apparatus that can be used with salon chairs, and, more generally, any adult-sized chairs, that will safely raise the height of a seated child while also occupying the child's attention so that the child is more likely to stay still and contented.

SUMMARY OF THE INVENTION

Embodiments of the present invention address the above-identified needs by providing booster seat and table combinations for use by children.

Aspects of the invention are directed to an apparatus for use with a chair. The apparatus comprises a booster seat, a table, and mounting hardware. The booster seat is adapted to be positioned on a seat of the chair and to act as a seat for a user. The table, in turn, includes a tabletop, a frontal sidewall, and a device mount. The frontal sidewall is oriented at an oblique angle relative to the tabletop, while the device mount is adapted to attach an electronic display device to the tabletop. Lastly, the mounting hardware is adapted to removably mount the table to the booster seat such that the tabletop is tilted towards the user when the user is seated in the booster seat.

Additional aspects of the invention are directed to an apparatus comprising a chair, a booster seat, a table, and mounting hardware. The chair defines a seat, and the booster seat is positioned on this seat and is adapted to act as a seat for a user. The table includes a tabletop, a frontal sidewall, and a device mount. The frontal sidewall is oriented at an oblique angle relative to the tabletop, while the device mount is adapted to attach an electronic display device to the tabletop. Lastly, the mounting hardware removably mounts the table to the booster seat such that the tabletop is tilted towards the user when the user is seated in the booster seat.

BRIEF DESCRIPTION OF THE DRAWINGS

These and other features, aspects, and advantages of the present invention will become better understood with regard to the following description, appended claims, and accompanying drawings where:

FIG. 4 shows an exploded perspective view of an apparatus in accordance with a second illustrative embodiment of the invention;

FIG. 5 shows a magnified perspective view of a first portion of the FIG. 4 apparatus;

FIG. 6 shows a magnified perspective view of a second portion of the FIG. 4 apparatus;

FIG. 7 shows an exploded perspective view of an apparatus in accordance with a third illustrative embodiment of the invention;

FIG. 8 shows an alternative seat-side mounting tube for use in the FIG. 7 apparatus;

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figure 1:
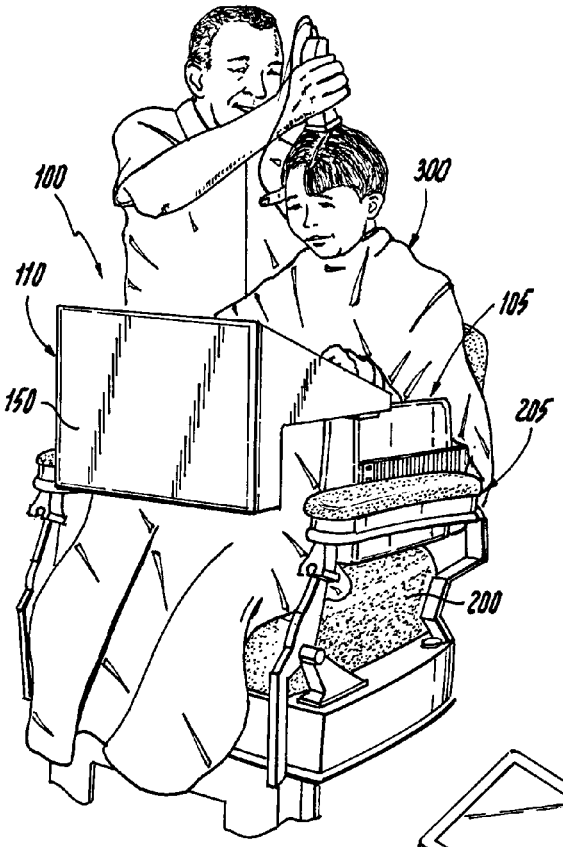
FIG. 1 shows a perspective view of an apparatus in accordance with a first illustrative embodiment of the invention while the apparatus is in use in a hair salon environment.
Figure 3:
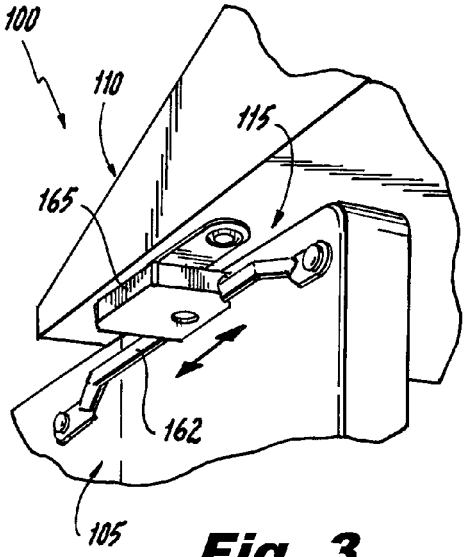
FIG. 3 shows a magnified perspective view of a portion of the FIG. 1 apparatus.
Figure 2:
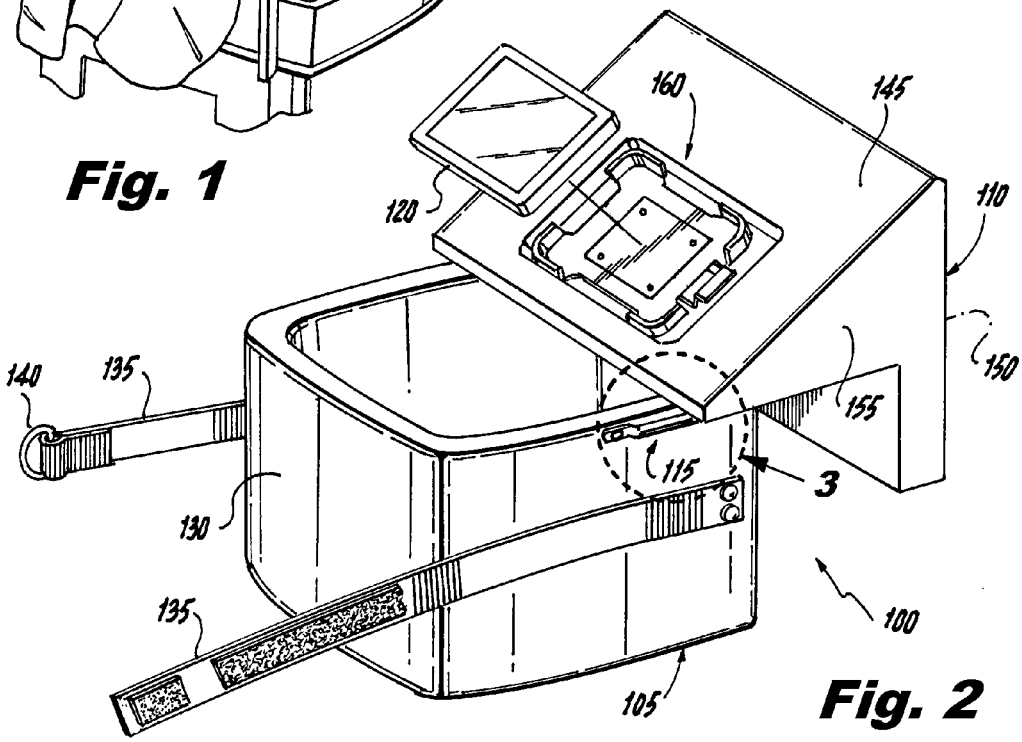
FIG. 2 shows a perspective view of the FIG. 1 apparatus while the apparatus is not in use.

FIGS. 1-3 show aspects of an apparatus 100 in accordance with a first illustrative embodiment of the invention. More particularly, FIG. 1 shows a perspective view of the apparatus 100 while the apparatus 100 is in use; FIG. 2 shows a perspective view of the apparatus 100 while the apparatus 100 is not in use; and FIG. 3 shows a magnified perspective view of a portion of the apparatus 100. In these figures, the illustrative apparatus 100 is shown as it might be used in a hair salon. Nevertheless, it is emphasized that embodiments of the invention are more generally applicable to other uses, and these other uses will also come within the scope of the invention.

The illustrative apparatus 100 may be conceptually broken down into a booster seat 105, a table 110, mounting hardware 115, and a computer 120, each of which serves one or more advantageous functions within the apparatus 100. The booster seat 105 is adapted to be positioned on a seat of an adult-sized chair, and to elevate a child sitting in the booster seat in relation to that chair. In FIG. 1, for example, the booster seat 105 is positioned on a seat 200 of an adult-sized salon chair 205 and is occupied by a child 300 receiving a haircut. This particular booster seat 105 comprises an elevated seat surrounded on three sides by a sidewall 130 (see FIG. 2). Two straps 135 emanate from the booster seat 105 and, when attached together utilizing a fastener 140, allow the booster seat 105 to be firmly secured to the salon chair 205.

The table 110 is mounted to the booster seat 105 and is adapted to secure the child 300 in the booster seat 105, to protect the child 300, and to provide the child 300 with entertainment. In the present illustrative embodiment, the table 110 comprises a tabletop 145, a frontal sidewall 150, two lateral sidewalls 155, and a device mount 160. Notably, when the table 110 is mounted to the booster seat 105, the tabletop 145 of the table 110 is tilted toward the child 300 so that the child 300 may easily see and access the computer 120. The frontal sidewall 150, in contrast, is oriented at an oblique angle relative to the tabletop 145 so that the frontal sidewall 150 is oriented substantially vertically relative to the child 300 and the salon chair 205 (i.e., substantially normal to a horizontal plane in the figures). In the particular embodiment shown in FIGS. 1-3, for example, the frontal sidewall 150 forms about a 60 degree angle with the tabletop 145, although it is again emphasized that this configuration is merely illustrative. In one or more non-limiting, alternative embodiments, the oblique angle between the frontal sidewall 150 and the tabletop 145 may be anywhere between, for example, about 30 degrees and about 60 degrees. In the present embodiment, the frontal sidewall 150 also extends downward well beyond the two lateral sidewalls 155, thereby defining a relatively large frontal face of the table 110.

Mounting of the table 110 to the booster seat 105 is via the mounting hardware 115, which may include any elements capable of removably fixating the table 110 to the booster seat 105 so that the table 110 is entirely supported thereby (e.g., latches, straps, pins, hook-and-loop materials, etc). In the particular embodiment shown in FIGS. 1-3, the mounting hardware 115 comprises two rails 162 and two latches 165. A representative one of the rails 162 and the latches 165 is visible in FIG. 3. The rail 162 is attached to the sidewall 130 of the booster seat 105. Correspondingly, the latch 165 (which may be spring-loaded) is attached to the bottom right edge of the table 110, and facilitates capture of the rail 162 at various places along the rail's length. Such a mounting system allows the table 110 to be manually attached to and removed from the booster seat 105. At the same time, the length of the rail 162 allows the horizontal positioning of the table 110 relative to the booster seat 105 (and, correspondingly, the child 300) to be varied. Children of different sizes are thereby accommodated. Mounting hardware 115 such as this is commercially available from, as just one example, Rockler Companies, Inc. (Medina, Minn., USA).

While the apparatus 100 in FIGS. 1-3 is shown as being adapted to accommodate a tablet-style computer, the invention is not limited to this particular type of device, and is more generally adaptable to accommodate any type of electronic display device. As the term is used herein, the term "electronic display device" is meant to be construed broadly, and incorporates any type of electronic device capable of displaying pictorial or video content to a user. An electronic display device may therefore comprise a computer, a video monitor, a television, and the like. In the illustrative embodiment shown in FIGS. 1-3, the device mount 160 includes a recessed region in the tabletop 145 that is sized to receive the computer 120, and spring-loaded edge mounting brackets by which to fixate the computer 120 once it is inserted therein. Alternative embodiments, however, may utilize very different mounting means, such as, but not limited to, clips, straps, hook-and-loop fasteners, etc. National Products, Inc. (Seattle, Wash., USA), for example, manufactures several different types of mounting mechanisms for portable computer devices, and many of these mounting mechanisms would be readily adaptable for use in embodiments of the present invention.

Configured as shown in FIGS. 1-3, the apparatus 100 becomes very easy to set up and tear down to accommodate children in applications such as hair salons without the need to obtain purpose-specific, child-sized chairs. A hair stylist, for example, upon being requested to perform services for a child too small for an adult-sized salon chair, may simply attach the booster seat 105 to the already-existing adult-sized salon chair 205 utilizing the straps 135, and then place the child 300 in the booster seat 105. Subsequently, the hair stylist may mount the table 110 to the booster seat 105 utilizing the mounting hardware 115, and then mount the computer 120 to the tabletop 145. In this manner, several advantageous functions are readily accomplished. The child 300 is elevated in the salon chair 205 and is kept securely in place by the table 110. At the same time, the frontal sidewall 150 of the table 110 protects the child's lower torso and legs. Lastly, because of the tilted tabletop 145, the child 300 is presented with pictorial or video entertainment from the computer 120 at an angle that does not require that the child 300 tilt his head downward. The child 300 is thereby caused to keep his head upright, which is particularly conducive to obtaining a haircut. Meanwhile, the entertainment keeps the child 300 occupied and contented, and thereby less prone to fidgeting or otherwise moving about. The chance of accidentally cutting the child 300 with a sharp instrument such as scissors or a razor are thereby reduced. Once the child 300 is serviced, the apparatus 100 may be readily removed from the salon chair 205 and the salon chair 205 returned to adult use until another child patron is present.

Advantageously, once understood from the disclosure provided herein, elements of the invention may be manufactured utilizing standard manufacturing techniques well within the capabilities of one having ordinary skill in the manufacturing arts. The booster seat 105 and the table 110 may, as just one non-limiting example, be predominantly formed of a lightweight plastic such as, but not limited to, polyethylene. This plastic may be solid, hollow, or a combination thereof. Suitable manufacturing techniques may include, as just one example, injection molding. In so manufacturing, device edges are preferably kept rounded to avoid sharp spots that may injure a child. Electronic display devices of the type contemplated herein are commercially available from sources such as Apple Inc. (Cupertino, Calif., USA) and Sony Corporation of America (New York, N.Y., USA).

It should again be emphasized that the above-described embodiments of the invention are intended to be illustrative only. Other embodiments can use different types and arrangements of elements for implementing the described functionality. These numerous alternative embodiments within the scope of the appended claims will be apparent to one skilled in the art.

For example, alternative embodiments in accordance with aspects of the invention may utilize booster seats, tables, and mounting hardware very different from those in the apparatus 100 presented above with reference to FIGS. 1-3. FIGS. 4-6 show aspects of an apparatus 400 in accordance with a second illustrative embodiment of the invention. FIG. 4 shows an exploded perspective view of the apparatus 400, while each of FIGS. 5 and 6 shows magnified perspective views of respective portions of the apparatus 400.

Like the apparatus 100 presented above, the apparatus 400 comprises a booster seat 405 and a table 410 with the table 410 being mountable to the booster seat 405 such that the table 410 is entirely supported thereby. What is more, much like the table 110, the table 410 comprises a tabletop 415, a frontal sidewall 420, two lateral sidewalls 425, and a device mount (located on the tabletop 415, although not visible in the figures). Here again, when the table 410 is mounted to the booster seat 405, the tabletop 415 of the table 410 is tilted toward a child sitting in the booster seat 405 so that the child may easily see and access a display device in the device mount. Here again, moreover, the frontal sidewall 420 is oriented at an oblique angle relative to the tabletop 415 so that the frontal sidewall 420 is oriented substantially vertically.

The means of mounting the table 410 to the booster seat 405, however, is very different from that presented above with reference to the apparatus 100, and, therefore, the apparatus 400 utilizes very different mounting hardware. More particularly, the apparatus 400 utilizes two mounting panels 430 to mount the table 410 to the booster seat 405. Each mounting panel 430 defines a respective pair of mounting pegs 435 along an edge closest to the booster seat 405, and a respective t-shaped track 440 along a top edge. Receiving holes 445 in the booster seat 405 and two t-shaped guides 450 that fit over the t-shaped tracks 440 on the table 410, in turn, allow the mounting panels 430 to removably attach to the booster seat 405 and to the table 410, and ultimately to span therebetween.

Advantageously the above-described mounting hardware allows a user to adjust both the elevation and horizontal positioning of the table 410 relative to the booster seat 405 to accommodate children of different sizes. Each of the t-shaped tracks 440 defines a respective series of apertures 455 along its length, while each of the t-shaped guides 450 includes a respective pin 460 that can pass through two aligned holes 465 in the t-shaped guide 450. When wishing to fixate the table 410 to the booster seat 405 (once a child is seated in the booster seat 405), a user may insert the respective pair of mounting pegs 435 of each mounting panel 430 into an appropriate pair of receiving holes 445 in the booster seat 405 so as to set the desired elevation of the table 410 relative to the booster seat 405. With the mounting panels 430 so fixated, the user may then slide the t-shaped guides 450 of the table 410 over the t-shaped tracks 440 on the mounting panels 430 until the desired horizontal positioning of the table 410 relative to the booster seat 405 is achieved and the holes 465 in the t-shaped guides 450 are indexed with corresponding apertures 455 in the t-shaped tracks 440. The pins 460 may then be inserted through the holes 465 and the apertures 455 to fixate the table 410 at this position. Subsequently, removing the table 410 may be achieved using an opposite sequence of actions.

FIG. 7 shows an exploded perspective view of an apparatus 700 in accordance with a third illustrative embodiment of the invention. Here again, the apparatus 700 comprises a booster seat 705 and a table 710. The table 710 itself comprises a tabletop 715, a frontal sidewall 720, and a device mount 725. Moreover, as before, the tabletop 715 is tilted so that a child seated in the booster seat 705 may easily see and access a display device in the device mount 725, while the frontal sidewall 720 is oriented at an oblique angle relative to the tabletop 715 so that the frontal sidewall 720 is oriented substantially vertically.

Unlike the previous embodiments, however, mounting of the table 710 to the booster seat 705 in the apparatus 700 is via a series of nesting cylindrical tubes that act to removably fixate the two elements. More particularly, as seen in FIG. 7, the table 710 includes a table-side tube 730 that attaches to the bottom of the table 710 and angles towards the booster seat 705. At the same time, a seat-side tube 735 having a diameter just slightly larger than that of the table-side tube 730 is attached to the booster seat 705 and is angled towards the table 710. Nesting the table-side tube 730 into the seat-side tube 735 thereby has the effect of mounting the table 710 to the booster seat 705. Of course, alternative embodiments may nest the seat-side tube 735 into the table-side tube 730. In either case, removing the table 710 is then a matter of merely sliding the table-side tube 730 out from the seat-side tube 735, or vice versa.

Because the seat-side tube 735 may be screwed into the booster seat 705, the apparatus 700 has the advantage of allowing the apparatus 700 to utilize already-existing, conventional booster seats. That is, the seat-side tube 735 may be retrofitted onto existing booster seats and the booster seats do not have to be specifically manufactured for use with the table 710. An alternative design for the seat-side tube 735, moreover, allows the positioning of the table 710 to be manually varied in relation to the booster seat 705. FIG. 8 shows a perspective view of an alternative seat-side tube 735' for use in the apparatus 700. The alternative seat-side tube 735' includes adjustable joints 800.

Figure 9:
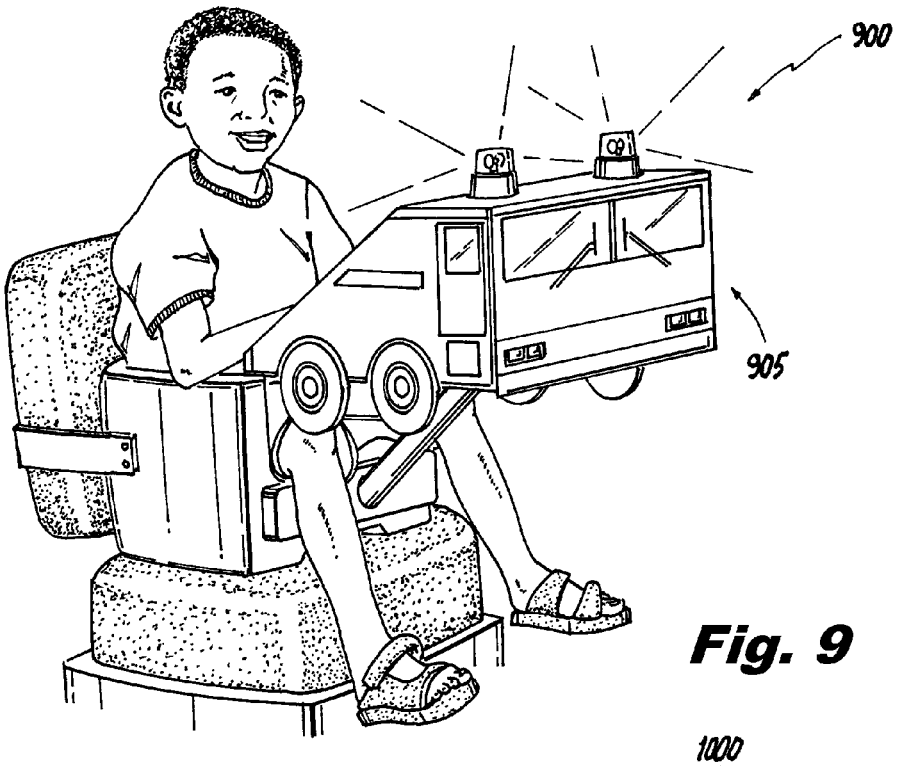
FIG. 9 shows a perspective view of an apparatus in accordance with a fourth illustrative embodiment of the invention while the apparatus is in use.
Figure 10:
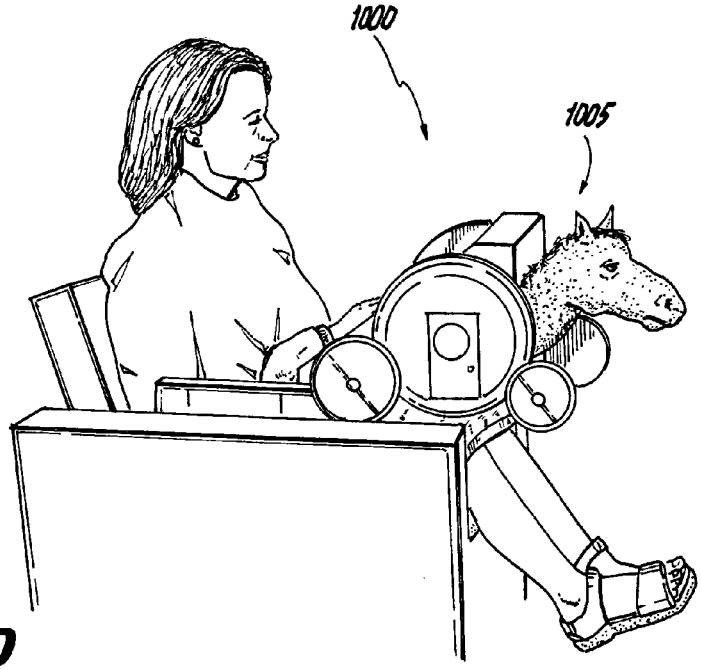
FIG. 10 shows a perspective view of an apparatus in accordance with a fifth illustrative embodiment of the invention while the apparatus is in use.

Lastly, it is contemplated that embodiments of the invention may be decorated and otherwise enhanced to make them more appealing to children, and thereby even further enhance the experience of a child beyond just the entertainment provided by an electronic display device. FIG. 9, for example, shows a perspective view of an apparatus 900 in accordance with a fourth illustrative embodiment of the invention while the apparatus 900 is in use. In this embodiment, a table 905 is decorated like a fire truck. FIG. 10, moreover, shows a perspective view of an apparatus 1000 in accordance with a fifth illustrative embodiment of the invention while the apparatus 1000 is in use. Here, a table 1005 is decorated like a carriage for a princess. In both embodiments, in addition to just decorations, faux steering wheels, reigns, levers, lights, etc. may also be present on the tables 905, 1005 to further enhance the experience of a child using the apparatus 900, 1000. Moreover, the child may even be allowed to dress in clothing (e.g., a hair salon cape) matching the theme of the apparatus 900, 1000, thereby making the experience even more immersive.

All the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

What is claimed is:

1. An apparatus for use with a chair, the apparatus comprising:

a booster seat, the booster seat adapted to be positioned on a seat of the chair and to act as a seat for a user;

a table, the table comprising:

a tabletop;

a frontal sidewall, the frontal sidewall oriented at an oblique angle relative to the tabletop; and a device mount, the device mount comprising at least one of a recess, a bracket, a clip, a strap, and a hook-and-loop fastener adapted to attach an electronic display device to the tabletop;

mounting hardware, the mounting hardware adapted to removably mount the table to the booster seat such that the tabletop is tilted towards the user when the user is seated in the booster seat; and an electronic display device, the electronic display device mounted to the tabletop by the device mount and operative to display at least one of pictorial and video content.

2. The apparatus of claim 1, further comprising one or more straps, the one or more straps adapted to secure the booster seat to the chair.

3. The apparatus of claim 1, wherein the oblique angle is between about 30 degrees and about 60 degrees.

4. The apparatus of claim 1, wherein the table further comprises two lateral sidewalls.

5. The apparatus of claim 4, wherein the frontal sidewall extends beyond the two lateral sidewalls.

6. The apparatus of claim 1, wherein the mounting hardware is adapted to allow the table to be mounted to the booster seat at more than one elevation relative to the booster seat.

7. The apparatus of claim 1, wherein the mounting hardware is adapted to allow the table to be mounted to the booster seat at more than one distance from the booster seat.

8. The apparatus of claim 1, wherein the mounting hardware comprises:

an elongate rail, the elongate rail attached to the booster seat; and a latch, the latch attached to the table and adapted to capture the elongate rail.

9. The apparatus of claim 8, wherein the booster seat defines a booster seat sidewall, and the elongate rail is attached to the booster seat sidewall.

10. The apparatus of claim 1, wherein the mounting hardware comprises a panel, the panel adapted to be removably fixated to the booster seat and to the table, and to span therebetween.

11. The apparatus of claim 10, wherein the panel is adapted to be removably fixated to the booster seat via one or more pegs and one or more receiving holes.

12. The apparatus of claim 10, wherein the panel is adapted to be removably fixated to the table via a track and a guide that fits over the track.

13. The apparatus of claim 1, wherein the mounting hardware comprises:

a seat-side tube, the seat-side tube attached to the booster seat; and a table-side tube, the table-side tube attached to the table;

wherein the table-side tube is adapted to nest inside the seat-side tube, or the seat-side tube is adapted to nest inside the table-side tube, to combine to form a support arm;

wherein the support arm spans between the booster seat and the table, and mounts the table to the booster seat with the tabletop tilted towards the user when the user is seated in the booster seat.

14. The apparatus of claim 13, wherein at least one of the seat-side tube and the table-side tube comprises a manually bendable joint.

15. An apparatus comprising:

a chair, the chair defining a seat;

a booster seat, the booster seat positioned on the seat of the chair and adapted to act as a seat for a user;

a table, the table comprising:

a tabletop;

a frontal sidewall, the frontal sidewall oriented at an oblique angle relative to the tabletop; and a device mount, the device mount comprising at least one of a recess, a bracket, a clip, a strap, and a hook-and-loop fastener adapted to attach an electronic display device to the tabletop; and mounting hardware, the mounting hardware removably mounting the table to the booster seat such that the tabletop is tilted towards the user when the user is seated in the booster seat; and an electronic display device, the electronic display device mounted to the tabletop by the device mount and operative to display at least one of pictorial and video content.

16. The apparatus of claim 15, wherein the chair is a salon chair.

* * * * *